United States Patent [19]

Lederer

[11] Patent Number: 4,746,906

[45] Date of Patent: May 24, 1988

[54] DUAL TECHNOLOGY INTRUDER DETECTION SYSTEM WITH MODULAR OPTICS

[75] Inventor: David B. Lederer, Rochester, N.Y.

[73] Assignee: Detection Systems, Inc., Fairport, N.Y.

[21] Appl. No.: 880,197

[22] Filed: Jun. 30, 1986

[51] Int. Cl.[4] ..... G08B 19/00; G08B 13/18

[52] U.S. Cl. ..... 340/522; 340/521; 340/552; 340/561; 340/565; 250/336.1; 250/347; 250/353

[58] Field of Search ..... 340/522, 565, 506, 521, 340/552, 554, 561; 367/94; 250/336.1, 347, 338–342, 353

[56] References Cited

U.S. PATENT DOCUMENTS

| | | | |
|---|---|---|---|
| 3,936,822 | 2/1976 | Hirschberg | 340/522 |
| 4,179,691 | 12/1979 | Keller | 340/565 |
| 4,468,658 | 8/1984 | Rossin | 340/565 |
| 4,660,024 | 4/1987 | McMaster | 340/522 |

*Primary Examiner*—Donnie L. Crosland
*Attorney, Agent, or Firm*—Warren W. Kurz

[57] ABSTRACT

Disclosed herein is a dual technology intruder detection system which features a modular optical system by which the field of protection of one subsystem can be changed relative to the field of view of the other by merely altering the orientation of one optical module relative to another. Such modular optical system includes a multifaceted reflector having two sets of planar reflective facets. Depending on the orientation of such multifaceted reflector relative to a separate spherical reflector, two different fields of view are provided, whereby false alarm-producing can be avoided.

3 Claims, 2 Drawing Sheets

DUAL TECHNOLOGY INTRUDER DETECTION SYSTEM WITH MODULAR OPTICS

BACKGROUND OF THE INVENTION

The present invention relates to the art of intrusion detection. More particularly, it relates to improvements in intruder detection systems of the so-called "dual technology" variety.

Heretofore, a variety of "technologies" have been used to detect the presence of an intruder in region under surveillance. Microwave, ultrasonic, photoelectric and passive infrared are some of the more common technologies in current use. Each has certain unique advantages and disadvantages which makes it more or less desirable for a particular environment or application. None is fool-proof, and all are subject to the ever-annoying false alarm.

In the never-ending struggle to provide the perfect intruder detection system, "perfect" from the standpoint that it never false alarms, proposals have been made to combine two (or more) technologies in a common intruder detection system. See, for example, the disclosure of U.S. Pat. Nos. 3,725,888; 3,801,978; 4,243,979; 4,275,390; 4,331,952; 4,660,024 and 4,401,976. While such proposals go back at least twenty five years (see, e.g., U.S. Pat. No. 3,074,053), only recently has the cost of electronics reached a level that has made commercialization of a "dual-tech" system viable.

In conventional dual-technology systems, the outputs of the different intruder-detecting subsystems (e.g. microwave and passive infrared subsystems) are fed to an AND gate or its equivalent. Only in the event that the outputs of both subsystems indicate that both subsystems have detected intrusion substantially simultaneously, or within a predetermined time interval, will the AND gate provide an alarm-activating signal. The advantage of such a system, of course, is that false alarms will only occur on the relatively rare occasion that a spurious or false alarming-producing event is detected by both subsystems at about the same time. By combining relatively diverse technologies, e.g. microwave and photoelectric or passive infrared, the probability of false alarming can be minimized.

While conventional dual technology intruder detection systems have, indeed, proven to be substantially more reliable and less susceptible to false alarming than "single technology" systems, they may still, given the right circumstances, false alarm. Consider, for example, the conventional passive IR/microwave dual technology system. Here, the microwave component transmits microwave radiation throughout a field of view which is both broad (e.g., 60 degree angular range) and deep (e.g., up to 500 feet in range), and looks for changes in frequency of the transmitted radiation, as produced by the well-known Doppler effect. Meanwhile, the passive IR subsystem monitors a plurality of discrete, narrow fields of view for temperature changes, as produced by the body heat of an intruder. Being passive in nature and looking for extremely small changes in temperature, the detection range of the IR component is substantially shorter than that of the active (microwave) subsystem, perhaps only about 10% as long. In installing such dual technology systems, there is a great tendency for the installer to ignore certain sources of false alarms of the IR subsystem even when there is reason to suspect that they are within one or more of the fields of view of such subsystem. The rationale for ignoring such sources is that, since the microwave component will not detect such spurious IR sources, there is no need to cure the problem, such as by either masking the optics of the troublesome field(s) of view of the IR subsystem or, alternatively, installing an entirely different type of system having different, presumably non-troublesome, fields of view. The fallacy of this rationale, of course, is that even though the microwave subsystem will not respond to temperature changes, it has its own peculiar set of false-alarm-producing sources, any one of which can produce a system false alarm if it occurs at substantially the same time as the spurious IR source occurs.

It is known in the intruder detection art to provide some passive IR detection systems with modular optical systems which facilitate quick changes in the optical pattern of protection. In such systems, the particular pattern of protection depends on the orientation of one optical component relative to another. For example, the Model DS 964 Passive Infrared Detection manufactured by assignee, Detection System, Inc., includes a movable, multifaceted reflector module comprising two set of individual planar reflectors. The position of this module is variable with respect to a stationary spherical reflector element to provide two different patterns of protection. Typically, one set of facets are arranged to provide so-called "barrier" protection, each of the individual fields of view being arranged in a common, say, vertical plane, and the other set of facets are arranged to provide broader coverage, in which case the facets are directed in different directions and in different planes. As of the date of the invention hereof, such modular optical systems have not been employed in the afore-described dual technology systems. As noted above, there did not seem to be a need for such.

SUMMARY OF THE INVENTION

In view of the foregoing discussion, an object of this invention is to provide an improved dual technology intruder detection system of the type which combines a passive IR intruder-detecting subsystem with an active subsystem, such as microwave or ultrasonic Doppler systems, a system which is improved at least from the standpoint that the field(s) of view of the IR subsystem is readily alterable to avoid known false-alarm-producing sources.

According to the invention, there is provided a dual technology intruder detection system which comprises, like similar prior art systems, (a) a first intruder-detecting subsystem including active means for transmitting energy into a broad field of view in which intrusion is is anticipated, and means for sensing variations in such energy as modified by objects moving within such field; and (b) a second intruder-detecting subsystem including passive means for sensing changes in radiation emanating from objects located within discrete narrow fields of view. The dual technology system of the invention, however, is characterized in that the passive subsystem includes a folded, modular, reflective optical system comprising (i) a fixed concave reflector for focusing incident radiation onto a radiation-sensitive detector; (ii) a multifaceted reflector element comprising a plurality of reflective planar facets arranged in two discrete sets, each set cooperating with the concave element to define a plurality of narrow fields of view arranged in a predetermined pattern, the field pattern of one set differing from that of the other; and (iii) means for supporting the multifaceted element in either of two operative positions relative to the concave reflector, whereby either one or the other field pattern is provided by said optical system.

The invention and its various advantages will be better understood from the ensuing detailed description of a preferred embodiment, reference being made to the accompanying drawings.

DETAILED DESCRIPTION OF PREFERRED EMBODIMENTS

Figure 1:
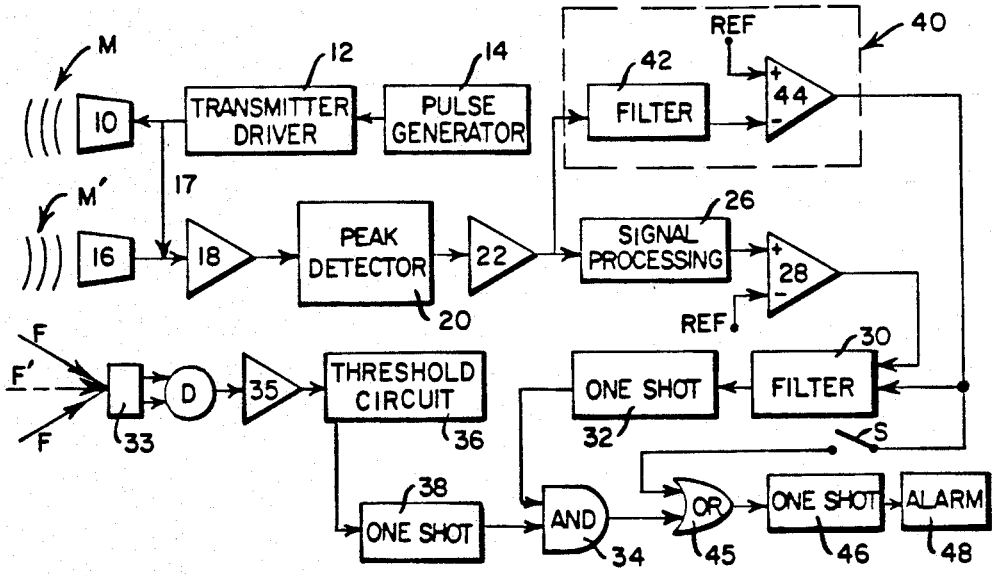
FIG. 1 is a block circuit diagram of a dual-tech intruder detection system embodying the present invention.

Referring now to the drawings, FIG. 1 illustrates a dual-tech intruder detection system of the microwave/infrared type. The microwave subsystem is "active" in nature, functioning to transmit microwave energy into a region to be protected from intrusion, and to detect such energy upon being reflected and possibly modified in frequency and/or phase by objects moving within such region. In contrast, the infrared subsystem is "passive" in nature, acting to detect the intruder's presence by his own body heat. As will be apparent, the technology of the intruder detecting subsystems could take any of many forms, active and/or passive.

Conventional microwave subsystems are commonly of the Doppler variety, typically comprising a Gunn diode 10 which is driven via a driver circuit 12 to produce modulated microwave energy M. The modulation may be prduced, for example, by a pulse generator 14 or some other periodic signal source. Movement of objects within the energy field produces a shift in frequency of the transmitted signal, such frequency shift being caused by the well-known Doppler effect. The Doppler frequency is the difference in frequency between the transmitted and motion-shifted frequencies, and it is this doppler signal which is processed to detect a particular type of movement.

The receiver portion of the microwave subsystem comprises a receiver diode 16 positioned to detect reflected microwave energy M, as returned from the protected area. A portion of the transmitted energy is directly coupled to the receiver, e.g., by locating the receiver diode within the energy field of the transmitting diode. Such coupling is denoted by the coupling line 17. In addition to providing a reference signal for subsequent Doppler frequency detection, the coupled energy also serves to bias the receiver "on" to demonstrate to a supervisory circuit that the transmitter is indeed transmitting and that the receiver is receiving.

In the particular microwave subsystem shown in FIG. 1, the output of receiver diode 16 is fed to an inverting pulse amplifier 18 whose output is peak-detected by detector 20 to produce the Doppler frequency. The Doppler signal is enhanced by amplifer 22 and the output thereof is filtered and further amplified in a conventional manner by an appropriate signal processing circuit 26 to exclude certain false alarm-producing signals. The output of circuit 26 is then threshold-detected by comparator 28 which compares the signal level with a reference voltage. Upon being further filtered by filter 30, the output of comparator 28 is used to trigger a conventional trigger circuit, e.g., a monostable multivibrator, denoted by one-shot 32. The pulse from the one shot, which may last one second or so, produces a "1" at one terminal of AND circuit 34, the other terminal of which is connected to the output of the passive infrared subsystem, described below. When both inputs to the AND circuit are "1", an alarm is produced through the series combination of OR circuit 45, a one-shot 46 and an alarm relay 48.

Briefly, the infrared subsystem comprises a standard IR detector D which is positioned to be irradiated by the body heat of an intruder within the protection region. As discussed below, a modular optical system 33 focuses infrared radiation onto the detector, such radiation emanating in any one or more of a plurality of different fields of view within the region under surveillance. The output of detector D is amplified by amplifier 35 and, after conventional signal processing and filtering, not shown, to minimize false alarming, the resulting signal is threshold detected by circuit 36 (e.g., a comparator). The output of threshold detector 36 is used to trigger a second trigger circuit, here shown as one-shot 38, and the output pulse thereof e.g., a one second pulse, is fed to the other input of AND circuit 34. A supervisory circuit 40 is provided to monitor the operability of the microwave subsystem and, in case of malfunction, to default to the passive IR subsystem. The output of such circuitry, which comprises filter 42 and comparator 44, serves as one of the inputs of an OR gate 45, the other input coming from the output of AND gate 34. The output of the OR gate activates an alarm relay 48 via a one shot 46. The operation of the supervisory aspects of the system is described in the commonly assigned and aforementioned U.S. Pat. No. 4,660,024 in the name of R. L. McMaster, the disclosure of which is incorporated by reference.

Figure 2A:
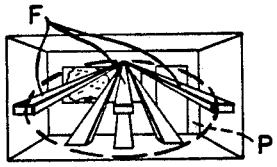
FIGS. 2*a* and 2*b* illustrate different patterns of protection afforded by the system of FIG. 1.
Figure 2B:
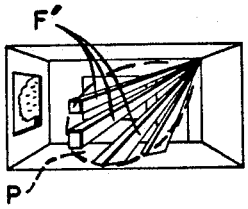

According to the present invention, modular optical system 33 is adapted to selectively provide, by a simple adjustment of the relative positions of two modular components, either of the two different patterns of protection shown in FIGS. 2*a* and 2*b*. That is, in addition to the broad microwave pattern of protection P, the pattern of protection afforded by the passive IR subsystem will be represented by either of the two multiple narrow fields of view F or F shown in FIGS. 2*a* and 2*b*, respectively. It will be appreciated that, having the ability to quickly and easily alter the field of view of the passive IR component will allow a system installer, faced with a potential false-alarm problem, to eliminate such problem, rather than ignore it and trust that the other subsystem (microwave) will not false alarm at the same time as the IR subsystem.

Figure 3:
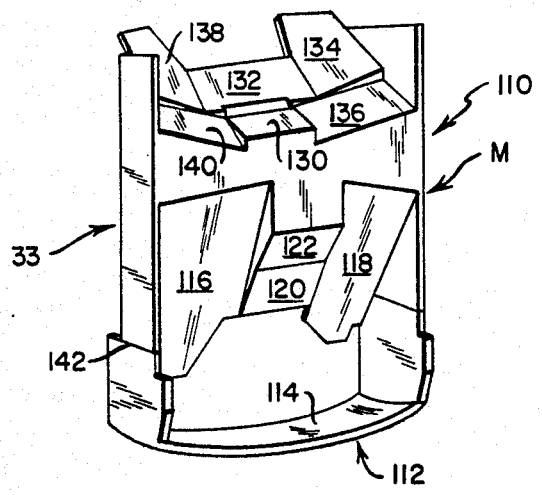
FIGS. 3–5 illustrate a modular optical system suited for use in the system of FIG. 1.
Figure 5:
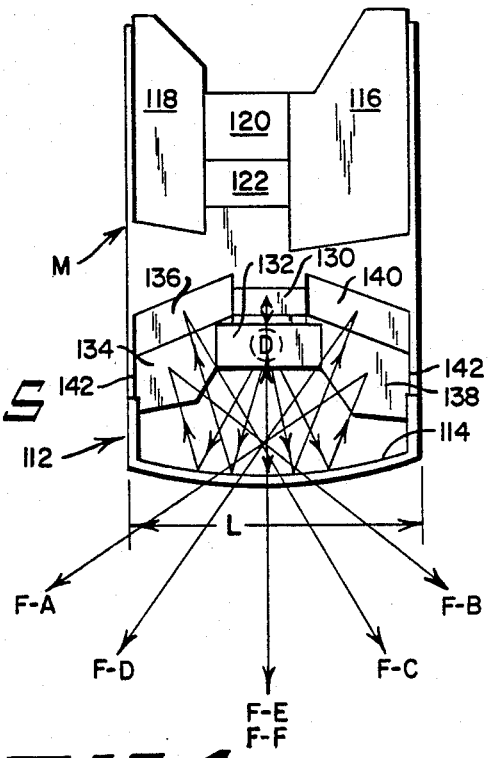
Figure 4:
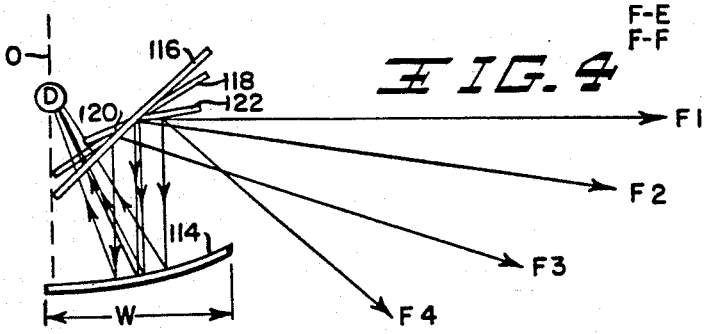

Referring now to FIGS. 3–5, modular optical system 33 is shown to comprise two components, a concave reflector 112 having a spherical reflective surface 114, and a multifaceted reflective module M. The latter comprises two sets of planar reflectors, one set consisting of reflective facets 116, 118, 120, and 122, and the other set consisting of facets 130, 132, 134, 136, 138 and 140. Concave reflector 112 is adapted to be rigidly coupled to the system housing (not shown) in the orientation shown in FIG. 3. Module M is supported by reflector 112 along an interface 142 in either the orientation shown in the perspective shown in FIG. 3, or in the flipped orientation shown in the front view of FIG. 5. When supported in the orientation shown in FIG. 3, planar facets 116, 118, 120 and 122 cooperate with the spherical reflector 114 to provide the field pattern shown in FIG. 2*b*. As shown, each of the distinct narrow fields of view F are in the same vertical plane, thereby providing a vertical barrier of protection. The manner in which facets 116, 118, 120 and 122 interact with reflector 112 is illustrated in FIG. 4. The four different fields of view shown in FIG. 2*b* are represented by the central rays F1–F4.

In the event one or more of the fields of view F shown in FIG. 2*b* presents a risk of false alarm, the installer may cure the problem by simply removing module M from its position atop reflector 112, turning it over (by 180 degrees) and replacing it in the orientation shown in FIG. 5. In this orientation, concave reflector 112 now cooperates with the other set of planar facets, 130, 132, 134, 138 and 140, to provide the broad field of protection represented by the six fields F shown in FIG. 2*a* and represented by the central rays F-A through F-F shown in FIG. 4. Presumably, the new fields of view will not encompass the potential source of false alarm.

The invention has been described with reference to a preferred embodiment. It is understood that various modifications can be made without departing from the spirit of the invention. For example, any two or more technologies can be combined to provide the dual (or multiple) technology advantage of the system, so long as one of the subsystems makes use of a "flip-flop" modular optical system of the type described.

I claim:

1. In a dual-technology intruder detection system comprising (a) a first intruder-detecting subsystem including active means for transmitting energy into a broad field of view in which intrusion is anticipated, and means for sensing variations in said energy as modified by objects moving within said broad field of view; and (b) a second intruder-detecting subsystem including passive means for sensing radiation emanating from objects within a plurality of discrete narrow fields of view within said broad field of view, the improvement wherein said second subsystem includes a folded, modular, reflective optical system comprising (i) a fixed concave reflector for focusing radiation incident thereon onto a radiation-sensitive detector, (ii) a multifaceted reflector comprising a plurality of planar reflective facets arranged in two discrete sets, each set of facets cooperating with said concave reflector to define a plurality of discrete narrow fields of view arranged in a predetermined pattern, the field pattern of one set differing from that of the other, and (iii) means for supporting said multifaceted reflector in either of two operative positions relative to said concave reflector, whereby either one or the other field pattern is provided by said optical system.

2. The invention according to claim 1 wherein said active means comprises means for transmitting microwave radiation into said broad field of view.

3. The invention according to claim 1 wherein said passive means comprises means means for sensing IR radiation emanating in said narrow fields of view.

* * * * *